US010378242B2

(12) United States Patent
Davis et al.

(10) Patent No.: US 10,378,242 B2
(45) Date of Patent: Aug. 13, 2019

(54) CONSTANT-CURRENT CONTROLLER FOR AN INDUCTIVE LOAD

(71) Applicant: Hanchett Entry Systems, Inc., Phoenix, AZ (US)

(72) Inventors: Brett L. Davis, Gilbert, AZ (US); Randall Shaffer, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 497 days.

(21) Appl. No.: 15/098,522

(22) Filed: Apr. 14, 2016

(65) Prior Publication Data

US 2016/0307683 A1 Oct. 20, 2016

Related U.S. Application Data

(60) Provisional application No. 62/147,478, filed on Apr. 14, 2015.

(51) Int. Cl.
*E05B 47/02* (2006.01)
*H01F 7/18* (2006.01)

(52) U.S. Cl.
CPC ..... *E05B 47/02* (2013.01); *H01F 7/1805* (2013.01); *H01F 2007/1888* (2013.01)

(58) Field of Classification Search
CPC ..... E05B 47/02; H01F 2007/1888
See application file for complete search history.

(56) References Cited

U.S. PATENT DOCUMENTS 3,663,949 A * 5/1972 Froeschle ..... H02M 3/10 323/287
4,536,728 A * 8/1985 Cyrot ..... H01F 7/08 335/182
4,542,440 A * 9/1985 Chetty ..... H02M 3/3378 361/100

(Continued)

FOREIGN PATENT DOCUMENTS

CN 204065891 U * 12/2014 ..... G05F 1/46
WO WO2014028332 A1 2/2014

OTHER PUBLICATIONS

Don Wilcher,"Learn Electronics with Ardurino," Jul. 2012, Apress, 1st ed., pp. 74-75.*

*Primary Examiner* — Pinping Sun
(74) *Attorney, Agent, or Firm* — Woods Oviatt Gilman LLP; Ronald J. Kisicki, Esq.

(57) ABSTRACT

A constant-current controller that supplies a constant current to an inductive load. This controller comprises an electric control circuit module. The electric control circuit module comprises a primary switch and a secondary switch. During a time interval in which the primary switch is closed ($t_{on}$), the secondary switch is open and the voltage across the inductive load is equal to the source voltage ($V_s$). At time $t_{on}$ until the end of a time interval (T), zero volts appears across the inductive load. During this interval, current continues to flow as supplied by the energy stored in the inductance. The periodic current in the inductive load becomes constant with a sufficiently large PWM switching frequency and is dependent upon the parameters of the control circuit and the duration of $t_{on}$.

9 Claims, 7 Drawing Sheets

(56) References Cited

U.S. PATENT DOCUMENTS

| | | | | |
|---|---|---|---|---|
| 4,841,207 | A * | 6/1989 | Cheyne | H02P 6/06 318/139 |
| 4,872,100 | A * | 10/1989 | Diaz | H02M 7/53803 363/41 |
| 6,356,043 | B2 * | 3/2002 | Baum | H02P 6/00 318/400.08 |
| 6,934,140 | B1 * | 8/2005 | Rober | H01H 47/325 361/154 |
| 7,158,361 | B2 * | 1/2007 | Horn | H02M 3/156 123/490 |
| 7,430,102 | B2 * | 9/2008 | Groh | F16D 48/064 361/160 |
| 7,813,101 | B2 * | 10/2010 | Morikawa | F16K 31/0603 361/152 |
| 8,941,417 | B2 * | 1/2015 | Dornseifer | H03K 19/00 327/110 |
| 9,183,976 | B2 | 11/2015 | Hanchett, Jr. et al. | |
| 2003/0128555 | A1 * | 7/2003 | Schemmann | H02M 3/3385 363/16 |
| 2004/0057183 | A1 * | 3/2004 | Vincent | H01F 7/18 361/118 |
| 2008/0238391 | A1 * | 10/2008 | Williams | H01F 7/1844 323/283 |
| 2009/0256534 | A1 * | 10/2009 | Videtich | H01H 47/325 323/235 |
| 2010/0156314 | A1 * | 6/2010 | Wang | H05B 33/0815 315/294 |
| 2011/0241629 | A1 * | 10/2011 | Jordan | H02M 3/07 320/166 |

* cited by examiner

CONSTANT-CURRENT CONTROLLER FOR AN INDUCTIVE LOAD

CROSS REFERENCE TO RELATED APPLICATIONS

This application claims the benefit of U.S. Patent Application No. 62/147,478, filed Apr. 14, 2015, the contents of which are hereby incorporated by reference in its entirety.

TECHNICAL FIELD

The present invention relates to a constant-current controller for an inductive load. More specifically, the invention relates to a constant-current controller that produces constant current via switches controlled by pulse-width modulation. Still more specifically, the invention relates to a constant-current controller that may be used, in one instance, in an electronically actuated door latch mechanism.

BACKGROUND OF THE INVENTION

Solenoids are often used as the driver to operate many types of electromechanical devices, such as for example electromechanical door latches or strikes. In the case of door latches, electromagnetic devices may also be used as drivers. In the use of solenoids as drivers in electromechanical door latches or strikes, the solenoids may be spring-biased to either a default locked or unlocked state, depending on the intended application of the strike or latch. When power is applied to the solenoid, the solenoid is powered away from the default state to bias a return spring. The solenoid will maintain the bias as long as power is supplied to the solenoid. Once power has been intentionally removed, or otherwise, such as through a power outage from the grid or as a result of a fire, the solenoid returns to its default locked or unlocked state.

In a fail-safe lock system, power is supplied to the solenoid to lock the latch or strike. With power removed, a return spring moves the mechanism to an unlocked state. Thus, as long as the latch or strike remains locked, power has to be supplied to the solenoid to maintain stored energy in the return spring.

The current to pull in the plunger of the solenoid is referred to as the "pick" current and the current to hold the plunger in its activated position is referred to as the "hold" current. Typically, the pick current is much greater than the hold current.

In a fail-secure system, the reverse is true. With power removed, the return spring moves the latching mechanism to a locked state. Thus, as long as the latch remains unlocked, power has to be supplied to the solenoid to maintain stored energy in the return spring. Again, the hold current is typically much less than the pick current.

A system designed to overcome the shortcomings of solenoid lock systems is disclosed in the prior art disclosure from Sargent Manufacturing Company (WO2014/028332—herein referred to as "the '332 publication"), the entirety of which is incorporated herein by reference. As disclosed in the '332 publication, the solenoid used to drive the door latch mechanism is replaced by a small DC motor that moves a latching plate. This change, in combination with the motor aligning with and engaging an auger/spring arrangement, reduced standby current consumption of the driver from about 0.5 A to about 15 mA.

U.S. Pat. No. 9,183,976, filed Mar. 15, 2013, and assigned to Hanchett Entry Systems, Inc. discloses a springless electromagnet actuator having a mode-selectable magnetic armature that may be used in door latching applications. A standard solenoid body and coils are combined with a non-magnetic armature tube containing a permanent magnet, preferably neodymium. The magnet is located in one of three positions within the armature. When biased toward the stop end of the solenoid, it may be configured to act as a push solenoid. When biased toward the collar end of the solenoid, it may be configured to act as a pull solenoid. In either case, no spring is required to return the armature to its de-energized position. Positioning the magnet in the middle of the armature defines a dual-latching solenoid requiring no power to hold it in a given state. In one aspect, a positive coil pulse moves the armature toward the stop end, whereas a negative coil pulse moves the armature toward the collar end. The armature will remain at the end to which it was directed until another pulse of opposite polarity is supplied to the actuator.

Irrespective of the type of electromagnetic actuator used, power to the inductive load of an electric latch or strike (such as a solenoid, DC motor, or magnetic actuator) is most efficiently maintained if a constant current is provided to the inductive load. Therefore, there exists a need for a constant-current controller operable to supply a constant current to the inductive load. The present invention fills this need and other needs.

SUMMARY OF THE INVENTION

What is presented is a constant-current controller that supplies a constant current to an inductive load. The inductive load is composed of an inductance (L) and series resistance (R). The controller comprises a switching circuit. The switching circuit comprises a primary switch and a secondary switch (see the schematic in FIG. 1). During a time interval in which the primary switch is closed ($t_{on}$), the secondary switch is open and the voltage across the inductive load is equal to the source voltage ($V_s$). At time to, until the end of a time period (T), with the primary switch open and the secondary switch closed, zero volts appears across the inductive load. During this interval, load current continues to flow due to the stored energy in the inductance. The periodic current in the inductive load is dependent upon the stored energy, the parameters of the control circuit, and the duration of $t_{on}$.

In certain embodiments, the controller further operates as a pulse-width modulation (PWM) controller that causes the periodic current in the inductive load to become constant by implementing a sufficiently large switching frequency. As the frequency increases, the boundary current and the peak current approach the same constant value. In certain embodiments of this controller, the inductive load can be a solenoid, DC motor, or a magnetic actuator. In certain embodiments of this controller, the primary switch is a MOSFET and said secondary switch is a free-wheeling diode. Although not a requirement, the inductive load can be used to lock or unlock an electromechanical door latch or electromechanical strike.

In one embodiment of this controller, the switching circuit comprises a current transformer, bridge rectifier, burden resistor, and low-pass filter. In this embodiment, the current transformer has two single-turn primary windings and one secondary winding. The first primary winding is connected in series with the primary switch; the second primary winding is connected in series with the secondary switch. The primary windings are used for sensing the current of the inductive load. The secondary winding has N-turns and is directly connected to the AC input of the bridge rectifier. The burden resistor is connected directly across the DC output of the bridge rectifier. The burden resistor is directly connected to the low-pass filter.

In another embodiment of this controller, the switching circuit comprises a current transformer, bridge rectifier, burden resistor, low-pass filter, and a timer integrated circuit (TIC). In this embodiment, the current transformer has two single-turn primary windings and one secondary winding. The first primary winding is connected in series with the primary switch; the second primary winding is connected in series with the secondary switch. The primary windings are used for sensing the current of the inductive load. The secondary winding has N-turns and is directly connected to the AC input of the bridge rectifier. The burden resistor is directly connected to the DC output of the bridge rectifier. The burden resistor is directly connected to the low-pass filter. The TIC establishes the time interval of the periodic current in the inductive load. To function in this manner, the TIC receives a signal through an input that initiates this time interval.

In another embodiment of this controller, the switching circuit comprises a current-sensing circuit and a PWM controller. The primary switch may be a transistor, such as a MOSFET; the secondary switch may be a diode or another MOSFET. The current sensing circuit may be a current-sense resistor with an amplifier, a current-sensing integrated circuit, a Hall-effect current sensor, or any other appropriate current sensing circuit known in the art. The current-sensing circuit feeds a voltage proportional to load current to the PWM controller which correspondingly adjusts the duty ratio to achieve the desired load current.

In another exemplary circuit implementation of the constant-current controller, the PWM controller controls the duty ratio of the primary switch. The PWM controller may be a software-programmable device such as a micro-processor or a firmware-programmable device such as a micro-controller or FPGA. The PWM controller may also contain the necessary circuitry to drive the primary switch. The primary switch may be a MOSFET or other appropriate switching device. A secondary switch may be a diode or other appropriate switching device. A current-sensing circuit provides a voltage proportional to load current to the PWM controller which adjusts the duty ratio to achieve the desired load current. The current-sensing circuit may be a current-sense resistor, a current-sense amplifier, a Hall-effect sensor, or other suitable current sensing circuit.

In this embodiment, the current-sensing circuit measures the current of inductive load when the primary switch is on and the secondary switch is off. When the primary switch is off, current continues to flow through the secondary switch during which the time current-sensing circuit continues to measure the current of the inductive load.

In yet another exemplary circuit implementation of the constant-current controller, the PWM controller controls the duty ratios of the primary switch and secondary switch. The PWM controller may be a software-programmable device such as a micro-processor or a firmware-programmable device such as a micro-controller or FPGA. The PWM controller may also contain the necessary circuitry to drive the primary switch and secondary switch. The primary switch may be a MOSFET or other appropriate switching device; the secondary switch may also be a MOSFET or other appropriate switching device. The current-sensing circuit provides a voltage proportional to load current to the PWM controller which adjusts the duty ratio to achieve the desired load current. The current-sensing circuit may be a current-sense resistor, a current-sense amplifier, a Hall-effect sensor, or other suitable current sensing circuit.

In this embodiment, the current-sensing circuit measures the current of the inductive load when the primary switch is on and the secondary switch is off. When the primary switch is off, the secondary switch is on and current continues to flow through the inductive load and the current-sensing circuit. When the secondary switch is on and the primary switch is off, the current-sensing circuit continues to measure the current of the inductive load. The PWM controller generates the appropriate signals to synchronously alternate the on-times and off-times of the primary and secondary switches, respectively.

What is also presented is a method of providing a constant-current to an inductive load. This method comprises the steps of sending an electric current to a switching circuit; sending the electric current through a primary switch during a time interval in which the primary switch is closed ($t_{on}$) and a secondary switch is open, which causes the voltage across the inductive load to be substantially equal to the source voltage ($V_s$); sending the electric current through the secondary switch during the time interval in which the secondary switch is closed and the primary switch is open, which causes the voltage across the inductive load to fall to 0. At $t_{on}$ until the end of a time period (T), zero volts appears across the inductive load. During this interval, load current continues to flow due to the stored energy in the inductance. The periodic current in the inductive load is dependent upon the stored energy, the parameters of the control circuit, and the duration of $t_{on}$.

In one embodiment of the method, the method further comprises the step of causing the periodic current in the inductive load to become constant through the implementation of a sufficiently large switching frequency generated through pulse-width modulation (PMW). In certain instances, the boundary current and the peak current are forced to substantially the same constant value as the PWM frequency increases. In certain embodiments of this method, the inductive load can be a solenoid, DC motor, or a magnetic actuator. In certain embodiments of this method, the primary switch is a MOSFET and said secondary switch is a free-wheeling diode. Although not a requirement, the inductive load can be used to lock or unlock an electromechanical door latch or electromechanical strike.

BRIEF DESCRIPTION OF THE DRAWINGS

The present invention will now be described, by way of example, with reference to the accompanying drawings, in which.

Corresponding reference characters indicate corresponding parts throughout the several views. The exemplifications set out herein illustrate currently preferred embodiments of the invention, and such exemplifications are not to be construed as limiting the scope of the invention in any manner.

DESCRIPTION OF THE PREFERRED EMBODIMENTS

Figure 1:
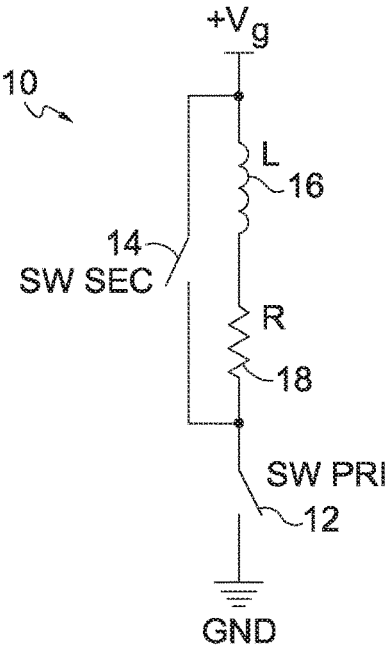
FIG. 1 is a functional schematic of a switching circuit, in accordance with an aspect of the present invention.

A functional schematic of the switching circuit 10 that produces constant current in an inductive load via switches controlled by pulse-width modulation (PWM) is shown in FIG. 1. As shown in the figure, there are two switches; a primary switch 12 and a secondary switch 14. When primary switch 12 is closed, the secondary switch 14 is open. When the primary switch 12 is open, the secondary switch 14 is closed. The series resistance (R), indicated in the circuit as resistor 18, is the sum of the coil resistance and the load resistance. Coil inductance and total circuit resistance comprise the inductive load.

In accordance with an aspect of the present invention, when primary switch 12 is closed, source voltage ($V_s$) is applied across inductor ("coil") 16 and resistor 18. However since coil 16 opposes any change in current flow by producing a counter electromotive force (EMF) equal to the source voltage, current flow through coil 16 and resistor 18 is zero at the instant the primary switch 12 is closed, i.e., ($t_0$). Once primary switch 12 is closed, the counter EMF begins to decay until the voltage across coil 16 and resistor 18 equals the source voltage $V_s$, thereby allowing a current to flow through coil 16 and resistor 18. The time interval in which primary switch 12 is closed may be defined as $t_{on}$.

At the beginning of the time interval when secondary switch 14 is closed and primary switch 12 is opened (i.e. from $t_{on}$ until the end of the cycle (T)), there is no longer a source voltage Vs across coil 16. Once again, coil 16 opposes the change in current flow by producing a positive EMF equal to the source voltage Vs in the direction that was the source voltage's direction. Therefore, current continues to flow through coil 16 and resistor 18 without source voltage Vs being applied. From $t_{on}$ to the end of the cycle T, current through and voltage across coil 16 and resistor 18 decays to zero via the EMF discharged by coil 16. As such, the current in the inductive load is dependent upon the circuit parameters and the rate at which the switches 12 and 14 are opened and closed with respect to each other. This rate is the PWM frequency (f).

Figure 5:
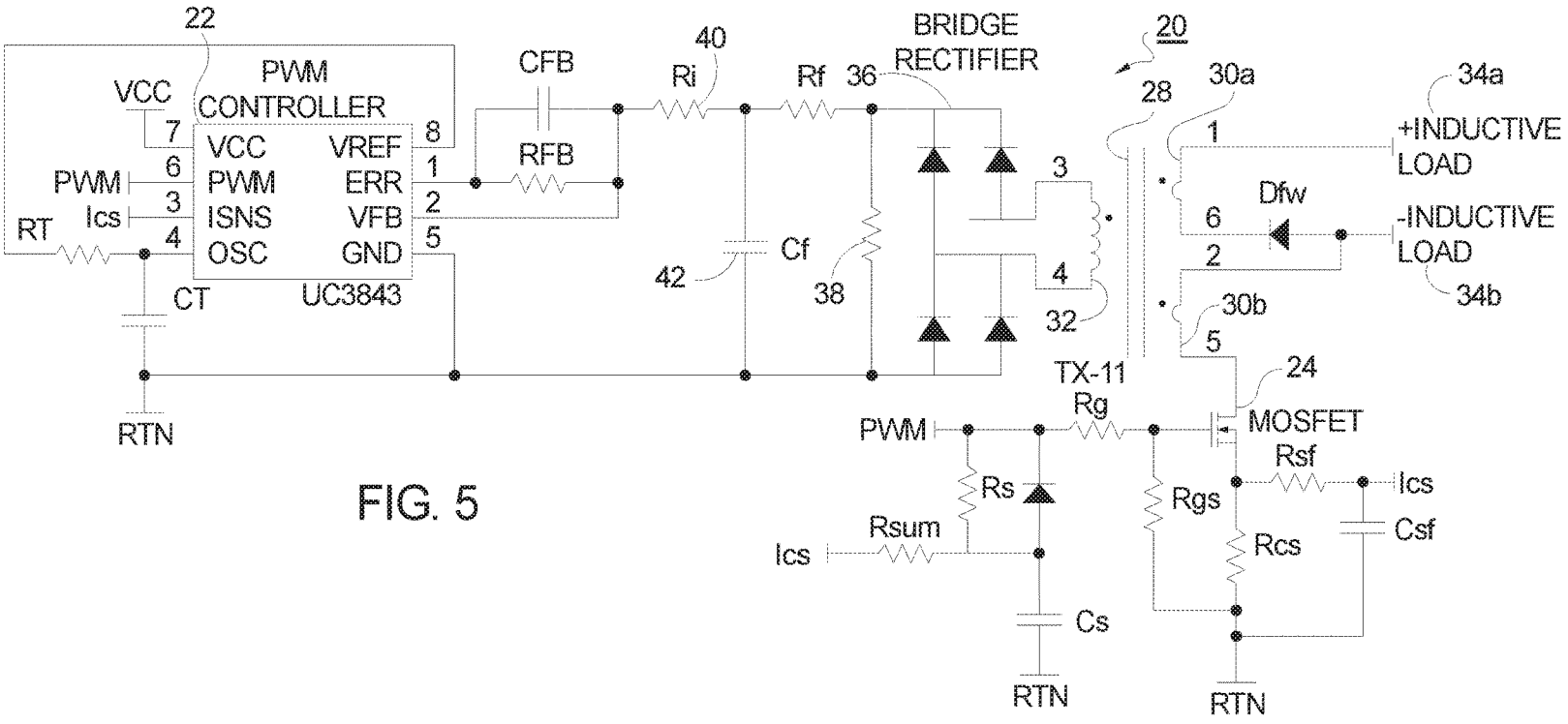
FIG. 5 is a schematic of an embodiment of a constant current PWM controller circuit, in accordance with an aspect of the present invention.

From the above discussion, it can be understood that current flow may be held constant by increasing the frequency in which the switches 12 and 14 are opened and closed. If the primary switch 12 is closed before the current decays to zero, the initial current becomes the boundary current. The load current is equal to the boundary current at the beginning and end of each period T. Non-zero boundary current increases the average value of the load current. As the period T is decreased substantially less than the L/R time constant, wherein L/R is the ratio of coil inductance to circuit resistance, the current may be held to any value between 0 and Vs/R by varying the duty ratio of primary switch 12, where the duty ratio is defined by $t_{on}/T$. This constant current control is especially useful since, in the example of a magnetic lock, power to the lock can be precisely controlled by varying the duty ratio (i.e., power can be increased to resist an instantaneous and unwanted attempt to open the door yet be reduced while the door is at idle). That is, for a sufficiently high frequency, the current is constant and can be maintained by a PWM controller so as to be any value between 0 and $V_s/R$, as will be discussed in more detail below with regard to FIGS. 5 and 6.

From the above description, it should be apparent that there are two switching intervals defined during one cycle of the PWM frequency. At the beginning of the cycle, primary switch 12 is closed (secondary switch 14 is open). During this interval, the load current is described by:

$$i_1(t) = A_1 e^{-\frac{t}{\tau}} + \frac{V_s}{R}$$

$$\tau = \frac{L}{R}$$

where τ (tau) is the circuit's time constant, L is the inductance of coil 16 and R is the series resistance.

Before the end of the cycle T, primary switch 12 is opened and secondary switch 14 is closed. As recounted above, this switching instant defines $t_{on}$ which represents the time during which the primary switch is closed. The ratio of $t_{on}$ to the PWM switching period is defined as the duty ratio:

$$D = \frac{t_{on}}{T}$$

After $t_{on}$ (i.e. when secondary switch 14 is closed) the secondary switch becomes a short circuit across the inductive load. During the interval from $t_{on}$ to T, the load current is described by $$i_2(t) = A_2 e^{-\frac{t}{\tau}}$$

The complete definition of the load current is thus described by two current components defined over their respective time intervals:

$$i_{LOAD} = \begin{cases} i_1(t) = A_1 e^{-\frac{t}{\tau}} + \frac{V_s}{R}, & 0 \le t \le t_{on} \\ i_2(t) = A_2 e^{-\frac{t}{\tau}}, & t_{on} \le t \le T \end{cases}$$

Constants $A_1$ and $A_2$ are determined from the boundary conditions.

Boundary Conditions

Since the load current is periodic, the two current components are equal at the beginning and at the end of the cycle:

$$i_1(0) = i_2(T)$$

Substitution of this boundary condition into the load current definition yields:

$$A_1 + \frac{V_s}{R} = A_2 e^{-\frac{T}{\tau}} \quad (1)$$

The two currents are also equal at $t_{on}$ because inductor current cannot change instantaneously:

$$i_1(t_{on}) = i_2(t_{on})$$

Substitution of this boundary condition yields:

$$A_1 e^{-\frac{t_{on}}{\tau}} + \frac{V_s}{R} = A_2 e^{-\frac{t_{on}}{\tau}} \quad (2)$$

The solution of Equations (1) and (2) for the constants is $$A_1 = -\frac{V_s}{R}\left[\frac{1 - e^{-T(1-D)/\tau}}{1 - e^{-T/\tau}}\right]$$

$$A_2 = -\frac{V_s}{R}\left[\frac{1 - e^{DT/\tau}}{1 - e^{-T/\tau}}\right]$$

Figure 2:
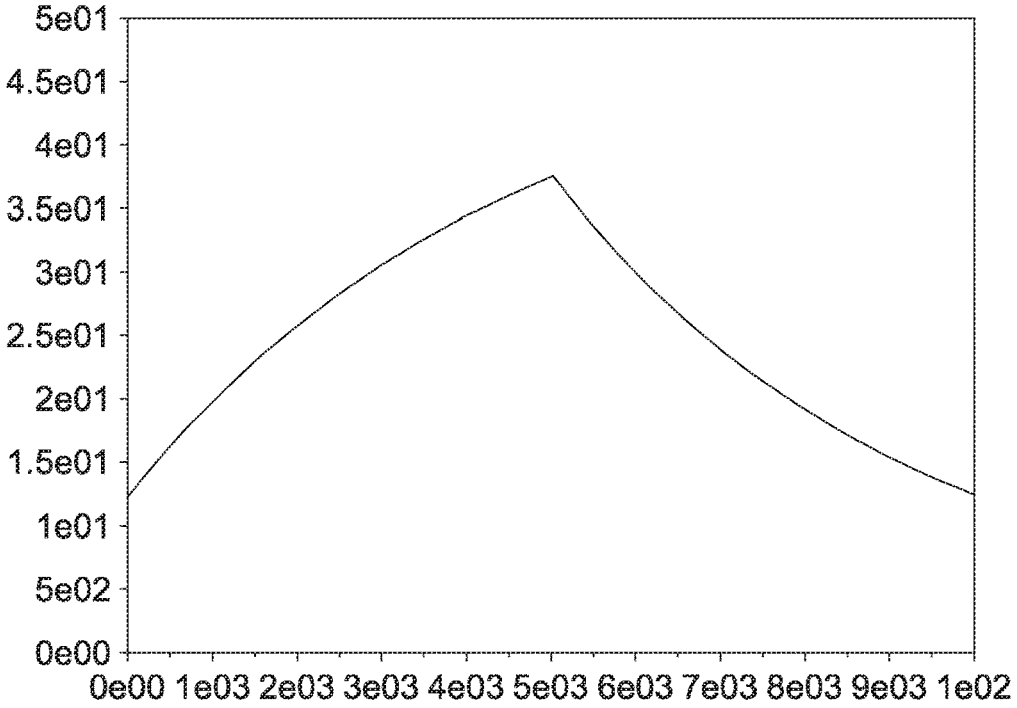
FIG. 2 is a plot of the instantaneous load current for the switching circuit shown in FIG. 1 at a switching frequency of 100 Hz.

A plot of the instantaneous load current during one PWM cycle is shown in FIG. 2 where $V_s$=25, L=220 mH, R=50Ω, f=100 Hz, and D=0.5. As can be seen in FIG. 2, the load current has the exponential forms characteristic of a first-order circuit. In this case, the circuit is composed of two sub-circuits; the first is supplied by a DC source while the second is source-free. Thus, the switching elements create a system of variable structure with a periodic current response. As outlined below, this periodic current may be made constant through the implementation of a sufficiently large PWM switching frequency.

Constant Current Control

The peak current is obtained upon substitution of $t = t_{on} = DT$ in either current component:

$$i_{pk} = \frac{V_s}{R}\left[\frac{1 - e^{-DT/\tau}}{1 - e^{-T/\tau}}\right]$$

The current at the beginning of the cycle is obtained upon substitution of t=0 in the first component:

$$i_1(0) = \frac{V_s}{R}\left[\frac{e^{-T(1-D)/\tau} - e^{-T/\tau}}{1 - e^{-T/\tau}}\right]$$

The same value is obtained upon substitution of t=T in the second current component:

$$i_2(T) = \frac{V_s}{R}\left[\frac{e^{-T(1-D)/\tau} - e^{-T/\tau}}{1 - e^{-T/\tau}}\right]$$

As the PWM frequency increases, the PWM period decreases. Specifically, as f approaches infinity, T approaches zero. As T→0, the peak current becomes:

$$\frac{V_s}{R}\left[\frac{1 - e^{-DT/\tau}}{1 - e^{-T/\tau}}\right] T \to 0 = \frac{DV_s}{R}$$

The boundary currents become:

$$\frac{V_s}{R}\left[\frac{e^{-T(1-D)/\tau} - e^{-DT/\tau}}{1 - e^{-T/\tau}}\right] T \to 0 = \frac{DV_s}{R}$$

Thus, the boundary current and the peak current approach the same constant value as the PWM frequency increases. Consequently, for a sufficiently high frequency, the load current is essentially constant and is dependent only on the source voltage Vs, series resistance R, and the duty ratio D:

$$i_{LOAD} = \frac{DV_s}{R}$$

A sufficiently high switching rate is one for which the switching period T is much less than the circuit time constant τ.

$$T \ll \tau$$

Conclusion

For high switching rates, the load current varies between 0 and $V_s/R$ as the duty ratio varies between 0 and 100%:

$$0 < i_{LOAD} < \frac{V_s}{R}$$

Figure 3:
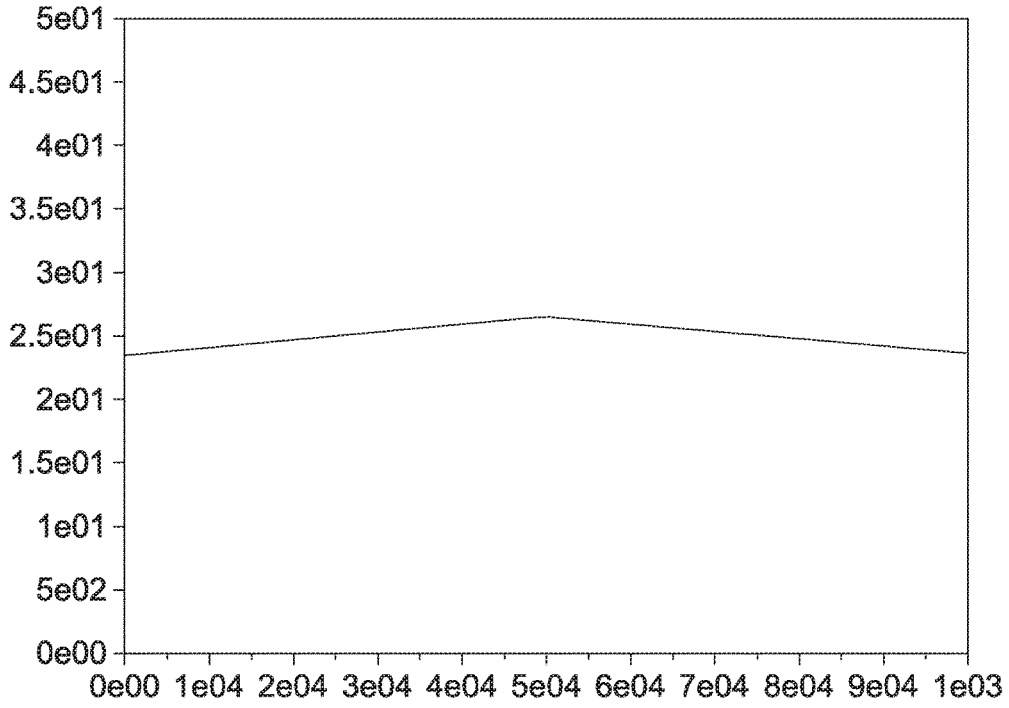
FIG. 3 is a plot of the instantaneous load current for the switching circuit shown in FIG. 1 at a switching frequency of 1,000 Hz.
Figure 4:
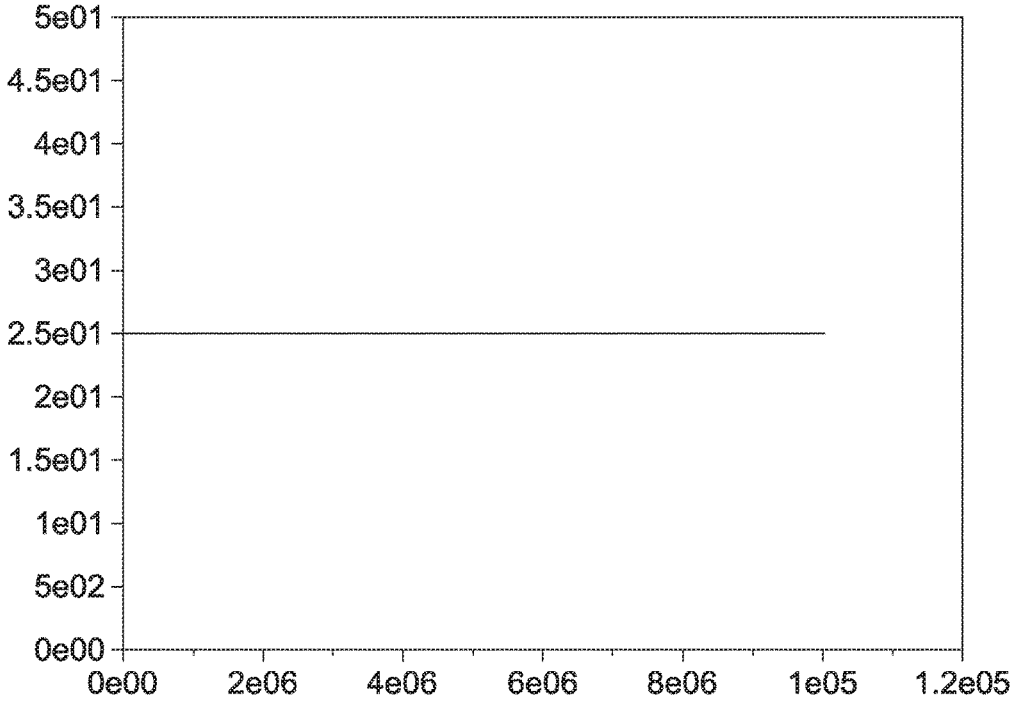
FIG. 4 is a plot of the instantaneous load current for the switching circuit shown in FIG. 1 at a switching frequency of 100,000 Hz.

By way of example, FIGS. 3 and 4 show load currents for switching rates of 1 kHz and 100 kHz, respectively.

Access Control Systems

One example of utilizing the above constant-current controller is within the field of access controls. For instance, it has been found that power to a latch having an inductive load actuator, such as but not necessarily limited to either a magnetic lock or a solenoid, is most efficiently provided if a constant current is provided to the latch. An exemplary circuit 20 for a constant-current PWM controller 22 is show in FIG. 5. The circuit makes use of a PWM controller integrated circuit 22 with current sensing used as the feedback mechanism. The primary switch 24 is typically a MOSFET (analogous to primary switch 12 described above) while the secondary switch 26 (i.e. switch 14) is typically a free-wheeling diode (shown as "Dfw"). It should be understood by those skilled in the art that any suitable switching device may be used in place of MOSFET 24 and diode 26 and that such alternative switches are to be considered within the scope of the present invention.

A current transformer 28 with two single-turn primary windings 30*a* and 30*b* and one secondary winding 32 with N-turns is used to sense the two components of the load current 34*a* and 34*b*. Primary windings 30*a* and 30*b* are connected in series with switches 24 and 26, respectively. Secondary winding 32 is connected to a bridge rectifier 36, burden resistor ($R_B$) 38, and low-pass filter resistor ($R_f$) 40 and capacitor ($C_f$) 42. It should be noted that any component having an equivalent functionality to the current transformer 28 may be installed within circuit 20. For example, a skilled artisan will see that the current transformer 28 may be replaced with Hall-effect sensors specified to have similar functionality.

When MOSFET 24 (i.e. primary switch 12) is on, the first current component flows through the primary winding at Terminals 3 and 4. This component is transformed to the secondary winding 32 as:

$$i_s = \frac{DV_s}{NR}, 0 \le t \le t_{on}$$

When MOSFET 24 turns off, the coil current continues to flow, due to the stored energy, but is now diverted into the free-wheeling diode 26 (i.e. secondary switch 14). This second current component now flows through the primary winding at Terminals 1 and 2. Due to the arranged phasing of the current transformer 28, the second current component is transformed to the secondary winding 32 as:

$$i_s = -\frac{DV_s}{NR}, t_{on} \le t \le T$$

The secondary currents are rectified through bridge rectifier 36 to produce a constant current through the burden resistor 38:

$$i_B = \frac{DV_s}{NR}, 0 \le t \le T$$

The value of the burden resistor is calculated to produce a voltage that is equal to the internal voltage reference, $V_r$, of the integrated circuit:

$$R_B = \frac{NR_r^V}{DV_s}$$

Thus, the value of burden resistance 38 establishes the feedback voltage to the PWM controller 22 at $V_r$. At this voltage, PWM controller 22 regulates the current through the inductive load to maintain the feedback voltage at this operating point. Thus, the value of $R_B$ establishes the value of the constant current through the inductive load.

Figure 6:
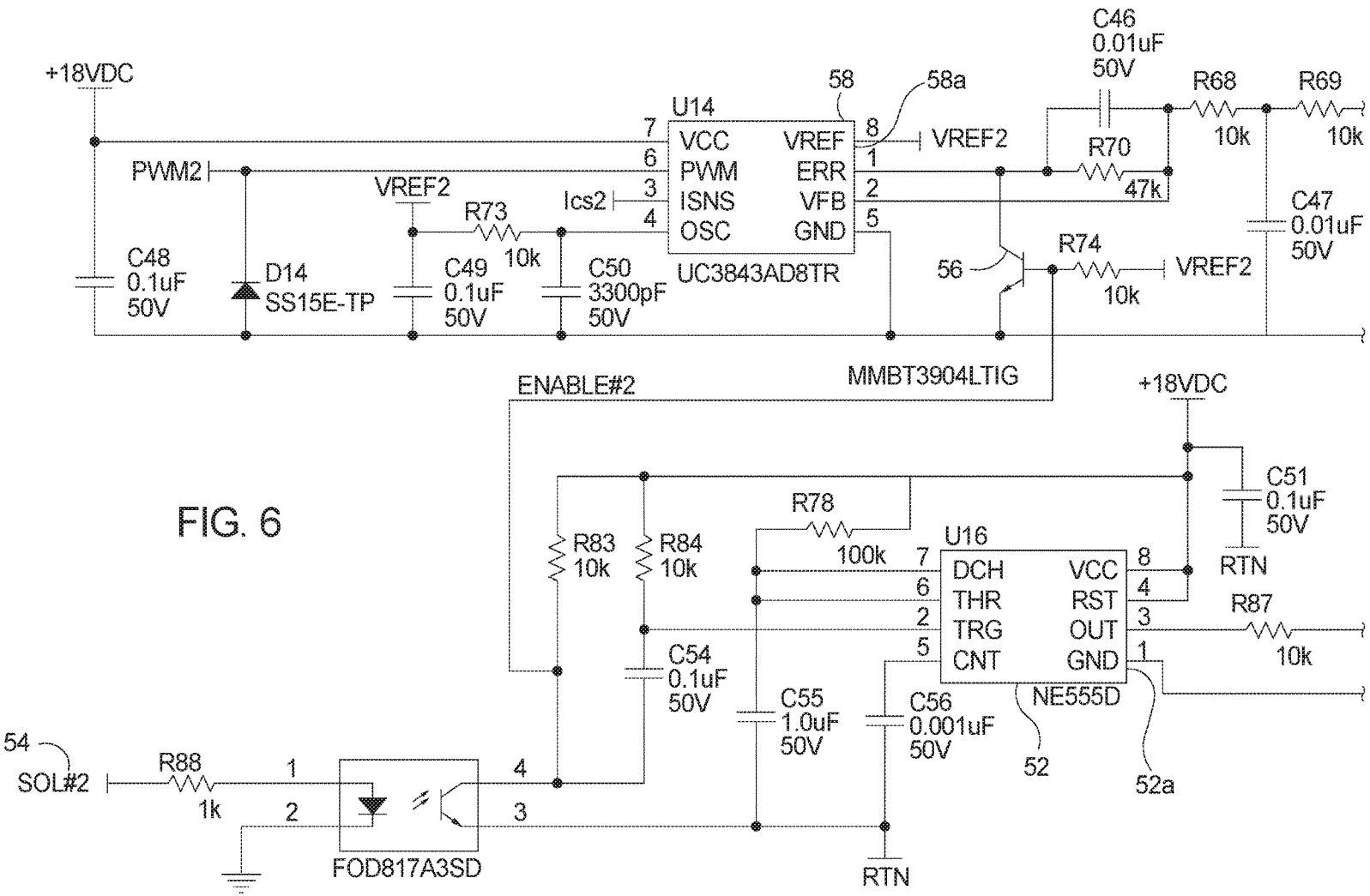
FIG. 6 is a schematic of another embodiment of a constant current PWM controller circuit configured for pick and hold states, in accordance with a further aspect of the present invention.
Figure 6:
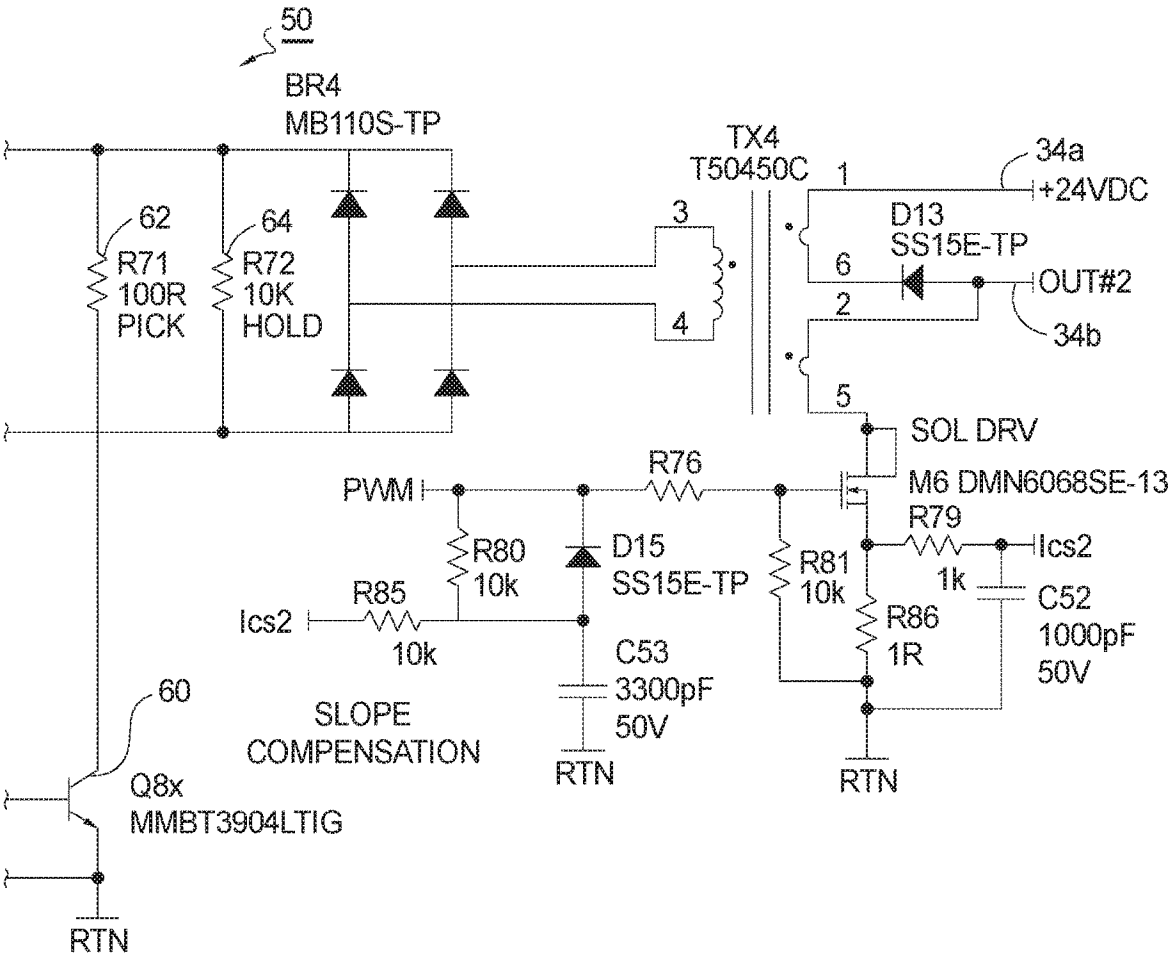

FIG. 6 shows another exemplary circuit schematic 50 that may be suitable for use in a latching system which employs a solenoid. As is recognized in the art, solenoid-driven actuators have long been known for their power inefficiencies. It is further known that their pull-in current (pick current) is higher than the current needed to hold the solenoid plunger in place (hold current). Therefore, to save energy, it is desirable for the controller to step down the current after the fixed duration of time during which the pick current has been applied. Furthermore, in a Fail-Secure system, the solenoid is often under full-power mode as long as the door needs to remain unlocked. Conversely, in a Fail-Safe system, the solenoid is in full-power mode as long as the door needs to remain locked. Thus, without further control, a significant amount of power is wasted while the solenoid remains powered.

To improve energy efficiencies, circuit 50 may use a combination of individual resistors in parallel to produce a collective burden resistor that may be used to change the operating current in the inductive load. In the case of a solenoid, two operating points are required, with the first being the pull-in or pick current. This relatively large current is sourced into the solenoid coil for a short time interval to engage the solenoid. Once the solenoid has been actuated, the pick current is followed by a much smaller holding or hold current to maintain the position of the solenoid plunger. In accordance with an aspect of the present invention, this pick and hold operation may be accomplished using a constant current controller by changing the value of the burden resistor once the solenoid has engaged, as will be discussed in greater detail below.

Circuit 50 makes use of a timer integrated circuit 52 to establish the time interval of the pull-in operation. The timer receives a signal through input 54 that initiates the pull-in interval. With no signal applied, transistor 56 (Q7) is on, Pin 1 (58*a*) of PWM controller 58 (U14) is pulled to ground such that PWM controller 58 is disabled. As a result, no current flows through the solenoid coil connected at terminals 34*a* (+24 VDC) and 34*b* (OUT#2).

When input 54 is switched to logic-level HIGH, PWM controller 58 is enabled and the pick interval starts with a logic-level HIGH at the OUT pin (52*a*) of timer integrated circuit 52. This output turns on transistor 60 (Q8) and connects resistor 62 (R71) and resistor 64 (R72) in parallel. This combined resistance value establishes the value of the pull-in current. Once the pull-in interval has expired, OUT pin 52*a* returns to a logic-level LOW, transistor 60 (Q8) turns off, and resistor 62 (R71) is disconnected from the circuit. Resistor 64 (R72) remains as the burden resistance and establishes the hold current of the solenoid. By way of example, if resistor 62 has a resistance of 100 ohms and resistor 64 has a resistance of 10,000 ohms and 24 V is being supplied, the pick current will be about 0.24 A (24 V/99 ohms=0.24 A) while the hold current will be about 2.4 mA (24 V/10,000 ohms=0.0024 A). In this manner, power efficiencies may be realized as high current is applied only for a set, limited period of time before the circuit switches to provide the less-demanding hold current.

It should be understood by those skilled in the art that the concept of multiple operating points with respective time intervals may be extended by the addition of any number of switched burden resistors with timing circuits. Such concepts are included within the present disclosure.

Figure 7:
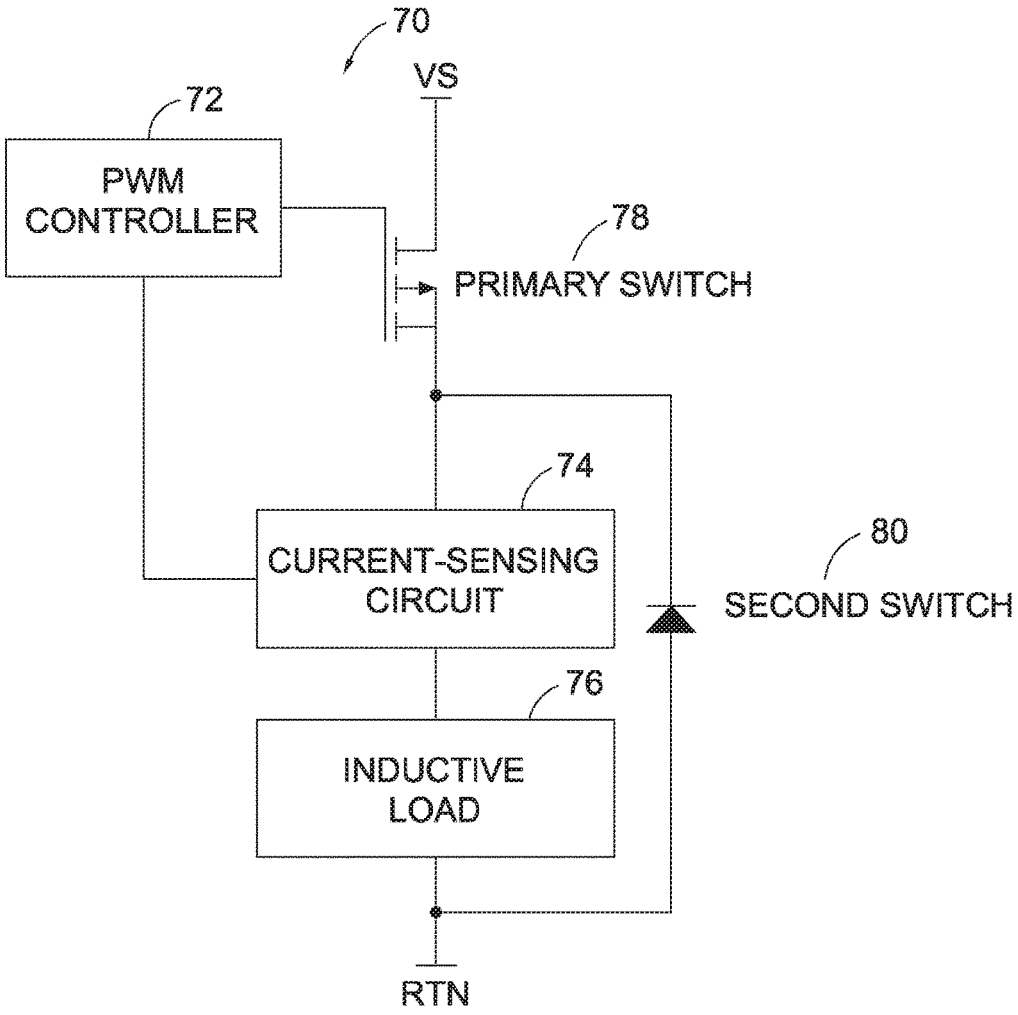
FIG. 7 is a generalized schematic of another embodiment of an asynchronous constant-current PWM controller in accordance with a further aspect of the present invention.

Another exemplary circuit implementation 70 of the constant-current controller is shown in FIG. 7. In this schematic, PWM controller 72 controls the duty ratio of primary switch 78. PWM controller 72 may be a software-programmable device such as a micro-processor or a firmware-programmable device such as a micro-controller or FPGA. PWM controller may also contain the necessary circuitry to drive primary switch 78. Primary switch 78 may be a MOSFET or other appropriate switching device; secondary switch 80 may be a diode or other appropriate switching device. Current-sensing circuit 74 provides a voltage proportional to load current to the PWM controller which adjusts the duty ratio to achieve the desired load current. The current-sensing circuit may be a current-sense resistor, a current-sense amplifier, a Hall-effect sensor, or other suitable current sensing circuit.

Current-sensing circuit 74 measures the current of inductive load 76 when primary switch 78 is on and secondary switch 80 is off. When primary switch 78 is off, current continues to flow through secondary switch 80 during which time current-sensing circuit 74 continues to measure the current of inductive load 76.

Figure 8:
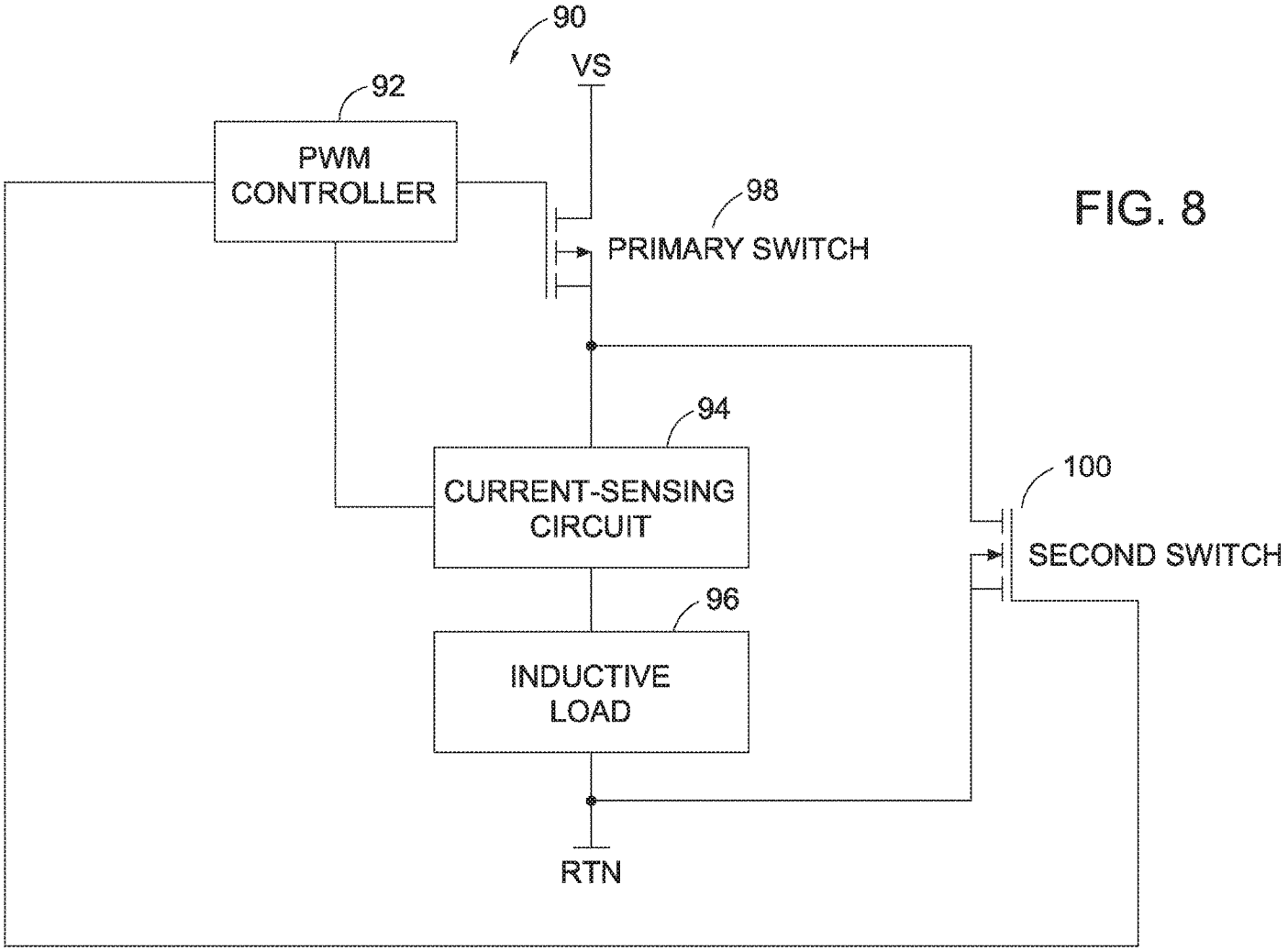
FIG. 8 is a generalized schematic of another embodiment of a synchronous constant-current PWM controller in accordance with a further aspect of the present invention.

A final exemplary circuit implementation 90 of the constant-current controller is shown in FIG. 8. In this schematic, PWM controller 92 controls the duty ratios of primary switch 98 and secondary switch 100. PWM controller 92 may be a software-programmable device such as a microprocessor or a firmware-programmable device such as a micro-controller or FPGA. PWM controller 92 may also contain the necessary circuitry to drive primary switch 98 and secondary switch 100. Primary switch 98 may be a MOSFET or other appropriate switching device; secondary switch 100 may be a MOSFET or other appropriate switching device. Current-sensing circuit 94 provides a voltage proportional to load current to the PWM controller which adjusts the duty ratio to achieve the desired load current. The current-sensing circuit may be a current-sense resistor, a current-sense amplifier, a Hall-effect sensor, or other suitable current sensing circuit.

Current-sensing circuit 94 measures the current of inductive load 96 when primary switch 98 is on and secondary switch 100 is off. When primary switch 98 is off, secondary switch 100 is on and current continues to flow through inductive load 96 and current-sensing circuit 94. When secondary switch 100 is on and primary switch 98 is off, current-sensing circuit 94 continues to measure the current of inductive load 96. PWM controller 92 generates the appropriate signals to synchronously alternate the on-times and off-times of primary and secondary switches 98 and 100, respectively.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A constant-current controller operable to supply a constant current to an inductive load, said constant-current controller comprising:

a) a switching circuit comprising:

1) a source voltage;

2) a primary switch;

3) a secondary switch; and 4) a current transformer comprising two primary windings for sensing a current of said inductive load and a secondary winding, wherein said two primary windings are connected in series with both said primary switch and said secondary switch, and said secondary switch is disposed between said two primary windings;

wherein, at $t_0$, when said primary switch is closed and said secondary switch is open, a first voltage across said inductive load and a circuit resistance is equal to said source voltage;

wherein, a time interval between $t_{on}$ and T, when said primary switch is open and said secondary switch is closed, said current continues to flow to said inductive load as supplied by energy stored in said inductive load, wherein a periodic current in said inductive load is dependent upon a time duration between said $t_0$ and said $t_{on}$, and wherein said constant-current controller operates as a pulse-width modulation controller to cause said periodic current in said inductive load to become constant through increasing a pulse-width modulation frequency to a frequency that has a switching period which is less than a circuit time constant.

2. The constant-current controller in accordance with claim 1, wherein a boundary current and a peak current approach the same constant value as said pulse-width modulation frequency increases.

3. The constant-current controller in accordance with claim 1, wherein said inductive load is selected from a group consisting of a solenoid, a DC motor and a magnetic actuator.

4. The constant-current controller in accordance with claim 1, wherein said secondary winding is connected to a rectifier, said rectifier connected to a burden resistor and a low-pass filter.

5. The constant-current controller in accordance with claim 4, wherein said switching circuit further comprises:

4) a timer integrated circuit configured to establish the time interval of said periodic current in said inductive load, wherein said timer integrated circuit receives a signal through an input to initiate said time interval.

6. The constant-current controller in accordance with claim 1, wherein said inductive load is configured as having a multiple-filar winding.

7. The constant-current controller in accordance with claim 1, wherein said primary switch is a MOSFET and said secondary switch is a free-wheeling diode.

8. A method of providing a constant-current to an inductive load, the method comprising the steps of:

a) sending an electric current to a switching circuit having a primary switch, a secondary switch, and a current transformer comprising two primary windings for sensing said electric current of said inductive load, and a secondary winding, wherein said two primary windings are connected in series with both said primary switch and said secondary switch, and said secondary switch is disposed between said two primary windings;

b) sending said electric current through said inductive load and said primary switch at $t_0$ in which said primary switch is closed and said secondary switch is open, causing a voltage across said inductive load to be substantially equal to a source voltage;

c) continuing said electric current through said inductive load and said primary switch until $t_{on}$ during which said primary switch is closed and said secondary switch is open;

d) sending said electric current through said inductive load during a time interval between said $t_{on}$ and T during which said secondary switch is closed and said primary switch is open, causing said voltage across said inductive load to equal 0, wherein between said $t_{on}$ and said T, said electric current continues to flow as supplied by energy stored in said inductive load, wherein a periodic current in said inductive load is dependent upon a duration of time between said $t_0$ and said $t_{on}$; and e) causing said periodic current in said inductive load to become constant through increasing a pulse-width modulated frequency to a frequency that has a switching period which is less than a circuit time constant.

9. The method in accordance with claim 8 further comprising the step of:

f) causing a boundary current and a peak current to approach the same value as said pulse-width modulated frequency increases.

* * * * *